US007552052B2

(12) United States Patent
Kemmochi

(10) Patent No.: US 7,552,052 B2
(45) Date of Patent: Jun. 23, 2009

(54) VOICE SYNTHESIS APPARATUS AND METHOD

(75) Inventor: Hideki Kemmochi, Hamamatsu (JP)

(73) Assignee: Yamaha Corporation (JP)

( * ) Notice: Subject to any disclaimer, the term of this patent is extended or adjusted under 35 U.S.C. 154(b) by 366 days.

(21) Appl. No.: 11/180,108

(22) Filed: Jul. 13, 2005

(65) Prior Publication Data

US 2006/0015344 A1 Jan. 19, 2006

(30) Foreign Application Priority Data

Jul. 15, 2004 (JP) ..... 2004-209033

(51) Int. Cl.
*G10L 13/02* (2006.01)

(52) U.S. Cl. ..... 704/258; 704/260; 704/265; 704/267; 704/268

(58) Field of Classification Search ..... 704/258, 704/260, 265, 267, 268, 269, E13.001, E13.002, 704/E13.004, E13.005, E13.008, E13.011, 704/E13.014
See application file for complete search history.

(56) References Cited

U.S. PATENT DOCUMENTS

| | | | | |
|---|---|---|---|---|
| 4,278,838 | A * | 7/1981 | Antonov | 704/260 |
| 6,029,131 | A * | 2/2000 | Bruckert | 704/260 |
| 6,308,156 | B1 | 10/2001 | Barry et al. | |
| 6,332,123 | B1 * | 12/2001 | Kaneko et al. | 704/276 |
| 6,785,652 | B2 * | 8/2004 | Bellegarda et al. | 704/266 |
| 6,836,761 | B1 * | 12/2004 | Kawashima et al. | 704/258 |
| 2001/0032079 | A1 * | 10/2001 | Okutani et al. | 704/258 |
| 2002/0184006 | A1 | 12/2002 | Yoshioka et al. | |
| 2003/0009336 | A1 * | 1/2003 | Kenmochi et al. | 704/258 |
| 2003/0009344 | A1 | 1/2003 | Kayama et al. | |

(Continued)

FOREIGN PATENT DOCUMENTS

EP 0 144 731 A2 6/1985

(Continued)

OTHER PUBLICATIONS

Relevant Portion of Extended European Search Report issued in corresponding European Patent Application No. 05106399.8-1224, dated May 22, 2007.

(Continued)

*Primary Examiner*—Daniel D Abebe
(74) *Attorney, Agent, or Firm*—Rossi, Kimms & McDowell LLP

(57) ABSTRACT

A plurality of voice segments, each including one or more phonemes are acquired in a time-serial manner, in correspondence with desired singing or speaking words. As necessary, a boundary is designated between start and end points of a vowel phoneme included in any one of the acquired voice segments. Voice is synthesized for a region of the vowel phoneme that precedes the designated boundary vowel phoneme, or a region of the vowel phoneme that succeeds the designated boundary in the vowel phoneme. By synthesizing a voice for the region preceding the designated boundary, it is possible to synthesize a voice imitative of a vowel sound that is uttered by a person and then stopped to sound with his or her mouth kept opened. Further, by synthesizing a voice for the region succeeding the designated boundary, it is possible to synthesize a voice imitative of a vowel sound that is started to sound with the mouth opened.

9 Claims, 5 Drawing Sheets

U.S. PATENT DOCUMENTS

| | | | | |
|---|---|---|---|---|
| 2003/0093280 | A1* | 5/2003 | Oudeyer | 704/266 |
| 2003/0159568 | A1 | 8/2003 | Kemmochi et al. | |
| 2003/0221542 | A1 | 12/2003 | Kenmochi et al. | |
| 2005/0137871 | A1* | 6/2005 | Capman et al. | 704/268 |
| 2006/0085196 | A1 | 4/2006 | Kayama et al. | |

FOREIGN PATENT DOCUMENTS

| | | | |
|---|---|---|---|
| EP | 1 220 194 | A2 | 7/2002 |
| JP | 2002-73069 | A | 3/2002 |
| JP | 2002-202790 | A | 7/2002 |
| JP | 2003-255974 | A | 9/2003 |

OTHER PUBLICATIONS

Notice of Grounds for Rejection issued in corresponding Japanese patent application No. 2004-209033, mailed Jul. 8, 2008.

* cited by examiner

| NOTE LENGTH t | TIME LENGTH FROM END POINT OF FRONT PHONEME TO BOUNDARY Bseg | TIME LENGTH FROM START POINT OF REAR PHONEME TO BOUNDARY Bseg |
|---|---|---|
| BELOW 50ms | 5ms | 5ms |
| OVER 50ms | (t−40)/2ms | (t−40)/2ms |

VOICE SYNTHESIS APPARATUS AND METHOD

BACKGROUND OF THE INVENTION

The present invention relates to voice synthesis techniques.

Heretofore, various techniques have been proposed for synthesizing voices imitative of real human voices. In Japanese Patent Application Laid-open Publication No. 2003-255974, for example, there is disclosed a technique for synthesizing a desired voice by cutting out a real human voice (hereinafter referred to as "input voice") on a phoneme-by-phoneme basis to thereby sample voice segments of the human voice and then connecting together the sampled voice segments. Each voice segment (particularly, voice segment including a voiced sound, such as a vowel) is extracted out of the input voice with a boundary set at a time point where a waveform amplitude becomes substantially constant. FIG. 8 shows a manner in which an example of a voice segment [s_a], comprising a combination of a consonant phoneme [s] and vowel phoneme [a], is extracted out of an input voice. As shown in the figure, a region Ts from time point T1 to time point T2 is designated as the phoneme [s] and a next region Ta from time point T2 to time point T3 is selected as the phoneme [a], so that the voice segment [s_a] is extracted out of the input voice. At that time, time point T3, which is the end point of the vowel phoneme [a] is set after time point T0 where the amplitude of the input voice becomes substantially constant (such time point T0 will hereinafter be referred to as "stationary point"). For example, a voice sound "sa" uttered by a person is synthesized by connecting the start point of the vowel phoneme [a] to the end point T3 of the voice segment [s_a].

However, because the voice segment [s_a] has the end point T3 set after the stationary point T0, the conventional technique can not necessarily synthesize a natural voice. Since the stationary point T0 corresponds to a time point when the person has gradually opened his or her mouth into a fully-opened position for utterance of the voice, the voice synthesized using the voice segment extending over the entire region including the stationary point T0 would inevitably become imitative of the voice uttered by the person fully opening his or her mouth. However, when actually uttering a voice, a person does not necessarily do so by fully opening the mouth. For example, in singing a fast-tempo music piece, it is sometimes necessary for a singing person to utter a next word before fully opening the mouth to utter a given word. Also, to enhance a singing expression, a person may sing without sufficiently opening the mouth at an initial stage immediately after the begining of a music piece and then gradually increasing the opening degree of the mouth as the tune rises or livens up. Despite such circumstances, the conventional technique is arranged to merely synthesize voices fixedly using voice segments corresponding to fully-opened mouth positions, it can not appropriately synthesize subtle voices like those uttered with the mouth insufficiently opened.

It is possible, in a fashion, to synthesize voices corresponding to various opening degrees of the mouth, by sampling a plurality of voice segments from different input voices uttered with various opening degrees of the mouth and selectively using any of the sampled voice segments. In this case, however, a multiplicity of voice segments must be prepared, involving a great amount of labor to create the voice segments; in addition, a storage device of a great capacity is required to hold the multiplicity of voice segments.

SUMMARY OF THE INVENTION

In view of the foregoing, it is an object of the present invention to appropriately synthesize a variety of voices without increasing the necessary number of voice segments.

To accomplish the above-mentioned object, the present invention provides an improved voice synthesis apparatus, which comprises: a phoneme acquisition section that acquires a voice segment including one or more phonemes; a boundary designation section that designates a boundary intermediate between start and end points of a vowel phoneme included in the voice segment acquired by the phoneme acquisition section; and a voice synthesis section that synthesizes a voice for a region of the vowel phoneme that precedes the designated boundary in said vowel phoneme, or a region of the vowel phoneme that succeeds the designated boundary in said vowel phoneme.

According to the present invention, a boundary is designated intermediate between start and end points of a vowel phoneme included in a voice segment, and a voice is synthesized based on a region of the vowel phoneme that precedes the designated boundary in the vowel phoneme, or a region that succeeds the designated boundary in the vowel phoneme. Thus, as compared to the conventional technique where a voice is synthesized merely on the basis of an entire region of a voice segment, the present invention can synthesize diversified and natural voices. For example, by synthesizing a voice for a region, of a vowel phoneme included in a voice segment, before a waveform of the region reaches a stationary state, it is possible to synthesize a voice imitative of a real voice uttered by a person without sufficiently opening the mouth. Further, because the region to be used to synthesize a voice for a voice segment is variably designated, there is no need to prepare a multiplicity of voice segments with regions different among the segments. Even if there is no need to prepare a multiplicity of voice segments, it is never intended to mean that the present invention excludes, from the scope of the invention, the idea or construction of, for example, preparing, for a same phoneme, a plurality of voice segments with different regions in pitch or dynamics (e.g., construction disclosed in Japanese Patent Application Laid-open Publication No. 2002-202790).

The "voice segment" used in the context of the present invention is a concept embracing both a "phoneme" that is an auditorily-distinguishable minimum unit obtained by dividing a voice (typically, a real voice of a person), and a phoneme sequence obtained by connecting together a plurality of such phonemes. The phoneme is either a consonant phoneme (e.g., [s]) or a vowel phoneme (e.g., [a]). The phoneme sequence, on the other hand, is obtained by connecting together a plurality of phonemes, representing a vowel or consonant, on the time axis, such as a combination of a consonant and a vowel (e.g., [s_a]), a combination of a vowel and a consonant (e.g., [i_t]) and a combination of successive vowels (e.g., [a_i]). The voice segment may be used in any desired form, e.g. as a waveform in the time domain (on the time axis) or as a spectrum in the frequency domain (on the frequency axis).

How or from which source the voice segment acquisition section acquires a voice segment may be chosen as desired by a user. More specifically, a read out section for reading out a voice segment stored in a storage section may be employed as the voice segment acquisition section. For example, where the present invention is applied to synthesize singing voices, the voice segment acquisition section, employed in arrangements which include a storage section storing a plurality of voice segments and a lyric data acquisition section (corresponding to "data acquisition section" in each embodiment to be detailed below) for acquiring lyric data designating lyrics or words of a music piece, acquires, from among the plurality of voice segments stored in the storage section, voice segments corresponding to lyric data acquired by the lyric data acquisition section. Further, the voice segment acquisition section may be arranged to either acquire, through communication, voice segments retained by another communication terminal, or acquire voice segments by dividing or segmenting each voice input by the user. The boundary designation section, which designates a boundary at a time point intermediate between the start and end points of a vowel, and it may also be interpreted as a means for designating a specific range defined by the boundary (e.g., region between the start or end point of the vowel phoneme and the boundary).

For a voice segment where a region including an end point is a vowel phoneme (e.g., a voice segment comprising only a vowel phoneme, such a [a], or phoneme sequence where the last phoneme is a vowel, such as [s_a] or [a_i]), a range of the voice segment is defined such that a time point at which a voice waveform of the vowel has reached a stationary state becomes the end point. When such a voice segment has been acquired by the voice segment acquisition section, the voice synthesis section synthesizes a voice based on a region preceding a boundary designated by the boundary designation section. With such arrangements, it is possible to synthesize a voice imitative of a real voice utter by a person before fully opening his or her mouth after started gradually opening the mouth in order to utter the voice. For a voice segment where a region including a start point is a vowel phoneme (e.g., a voice segment comprising only a vowel phoneme, such as [a], or phoneme sequence where the first phoneme is a vowel, such as [a_s] or [i_a]), a range of the voice segment is defined such that a time point at which a voice waveform of the vowel has reached a stationary state becomes the start point. When such a voice segment has been acquired by the voice segment acquisition section, the voice synthesis section synthesizes a voice based on a region succeeding a boundary designated by the boundary designation section. With such arrangements, it is possible to synthesize a voice imitative of a real voice uttered by a person while gradually closing his or her mouth after having opened the mouth partway.

The above-identified embodiments may be combined as desired. Namely, in one embodiment, the voice segment acquisition section acquires a first voice segment where a region including an end point is a vowel phoneme (e.g., a voice segment [s_a] as shown in FIG. 2) and a second voice segment where a region including a start point is a vowel phoneme (e.g., a voice segment [a_#] as shown in FIG. 2), and the boundary designation section designates a boundary in the vowel of each of the first and second voice segments. In this case, the voice synthesis section synthesizes a voice on the basis of both a region of the first voice segment preceding the boundary designated by the boundary designation section and a region of the second voice segment following the boundary designated by the boundary designation section. Thus, a natural voice can be obtained by smoothly interconnecting the first and second voice segments. Note that it is sometimes impossible to synthesize a voice of a sufficient time length by merely interconnecting the first and second voice segments. In such a case, arrangements are employed for appropriately inserting a voice to fill or interpolate a gap between the first and second voice segments. For example, the voice segment acquisition section acquires a voice segment divided into a plurality of frames, and the sound synthesis section generates a voice to fill the gap between the first and second voice segments by interpolating between the frame of the first voice segment immediately preceding a boundary designated by the boundary designation section and the frame of the second voice segment immediately succeeding the boundary designated by the boundary designation section. Such arrangement can synthesize a natural voice over a desired time length with the first and second voice segments smoothly interconnected by interpolation. More specifically, the voice segment acquisition section acquires frequency spectra for individual ones of a plurality of divide frames of a voice segment, and the voice synthesis section generates a frequency spectrum of a voice to fill a gap between first and second voice segments by inserting between a frequency spectrum of a frame of the first voice segment immediately preceding a boundary designated by the boundary designation section and a frequency spectrum of a frame of the second voice segment immediately succeeding the boundary designated by the boundary designation section. Such arrangements can advantageously synthesize a voice through simple frequency-domain processing. Whereas the interpolation between the frequency spectra has been discussed above, the voice to fill the gap between the successive frames may alternatively be inserted or interpolated on the basis of parameters of the individual frames, by previously expressing the frequency spectra and characteristic shapes of spectral envelopes (e.g., gains and frequencies at peaks of the frequency spectra, and overall gains and inclinations of the spectral envelopes).

It is desirable that a time length of a region of a voice segment to be used in voice synthesis by the voice synthesis section be chosen in accordance with a duration time length of a voice to be synthesized here. Thus, in one embodiment, there is further provided a time data acquisition section that acquires time data designating a duration time length of a voice (corresponding to the "data acquisition section" in the embodiments to be described later), and the boundary designation section designates a boundary in a vowel phoneme, included in the voice segment, at a time point corresponding to the duration time length designated by the time data. Where the present invention is applied to synthesize singing voices, the time data acquisition section acquires data indicative of a duration time length (i.e., note length) of a note constituting a music piece, as time data (corresponding to note data in the embodiments to be detailed below). Such arrangements can synthesize a natural voice corresponding to a predetermined duration time length. More specifically, when the voice segment acquisition section has acquired a voice segment where a region having an end point is a vowel, the boundary designation section designates, as a boundary, a time point of the vowel phoneme, included in the voice segment, closer to the end point as a longer time length is indicated by the time data, and the voice synthesis section synthesizes a voice on the basis of a region preceding the designated boundary. Further, when the voice segment acquisition section has acquired a voice segment where a region having a start point is a vowel, the boundary designation section designates, as a boundary, a time point of the vowel phoneme, included in the voice segment, closer to the start point as a longer time length is indicated by the time data, and the voice synthesis section synthesizes a voice on the basis of a region succeeding the designated boundary.

However, in the present invention, any desired way may be chosen to designate a boundary in a vowel phoneme. For example, in one embodiment, the voice synthesis apparatus further includes an input section that receives a parameter input thereto, and the boundary designation section designates a boundary at a time point of a vowel phoneme, included in a voice segment acquired by the voice segment acquisition section, corresponding to the parameter input to the input section. In this embodiment, each region of a voice segment, to be used for voice synthesis, is designated in accordance with a parameter input by the user via the input section, so that a variety of voices with user's intent precisely reflected therein can be synthesized. Where the present invention is applied to synthesize singing voices, it is desirable that time points corresponding to a tempo of a music piece be set as boundaries. For example, when the voice segment acquisition section has acquired a voice segment where a region including an end point is a vowel phoneme, the boundary designation section designates, as a boundary, a time point of the vowel phoneme closer to the end point as a slower tempo of a music piece is designated, and the voice synthesis section synthesizes a voice on the basis of a region of the vowel phoneme preceding the boundary. When the voice segment acquisition section has acquired a voice segment where a region including a start point is a vowel phoneme, the boundary designation section designates, as a boundary, a time point of the vowel phoneme closer to the start point as a slower tempo of a music piece is designated, and the voice synthesis section synthesizes a voice on the basis of a region of the vowel phoneme succeeding the boundary.

The voice synthesis apparatus may be implemented not only by hardware, such as a DSP (Digital Signal Processor), dedicated to voice synthesis, but also by a combination of a personal computer or other computer and a program. For example, the program causes the computer to perform: a phoneme acquisition operation for acquiring a voice segment including one or more phonemes; a boundary designation operation designating a boundary intermediate between start and end points of a vowel phoneme included in the voice segment acquired by the phoneme acquisition operation; and a voice synthesis operation for synthesizing a voice for a region, of the vowel phoneme included in the voice segment acquired by the phoneme acquisition operation, preceding the boundary designated by the boundary designation operation, or a region of the vowel phoneme succeeding the designated boundary. This program too can achieve the benefits as set forth above in relation to the tone synthesis apparatus of the invention. The program of the invention may be supplied to the user in a transportable storage medium and then installed in a computer, or may be delivered from a server apparatus via a communication network then installed in a computer.

The present invention is also implemented as a voice synthesis method comprising: a phoneme acquisition step of acquiring a voice segment including one or more phonemes; a boundary designating step of designating a boundary intermediate between start and end points of a vowel phoneme included in the voice segment acquired by the phoneme acquisition step; and a voice synthesis step of synthesizing a voice for a region, of the vowel phoneme included in the voice segment acquired by the phoneme acquisition step, preceding the boundary designated by the boundary designation step, or a region of the vowel phoneme succeeding the designated boundary. This method too can achieve the benefits as stated above in relation to the voice synthesis apparatus.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
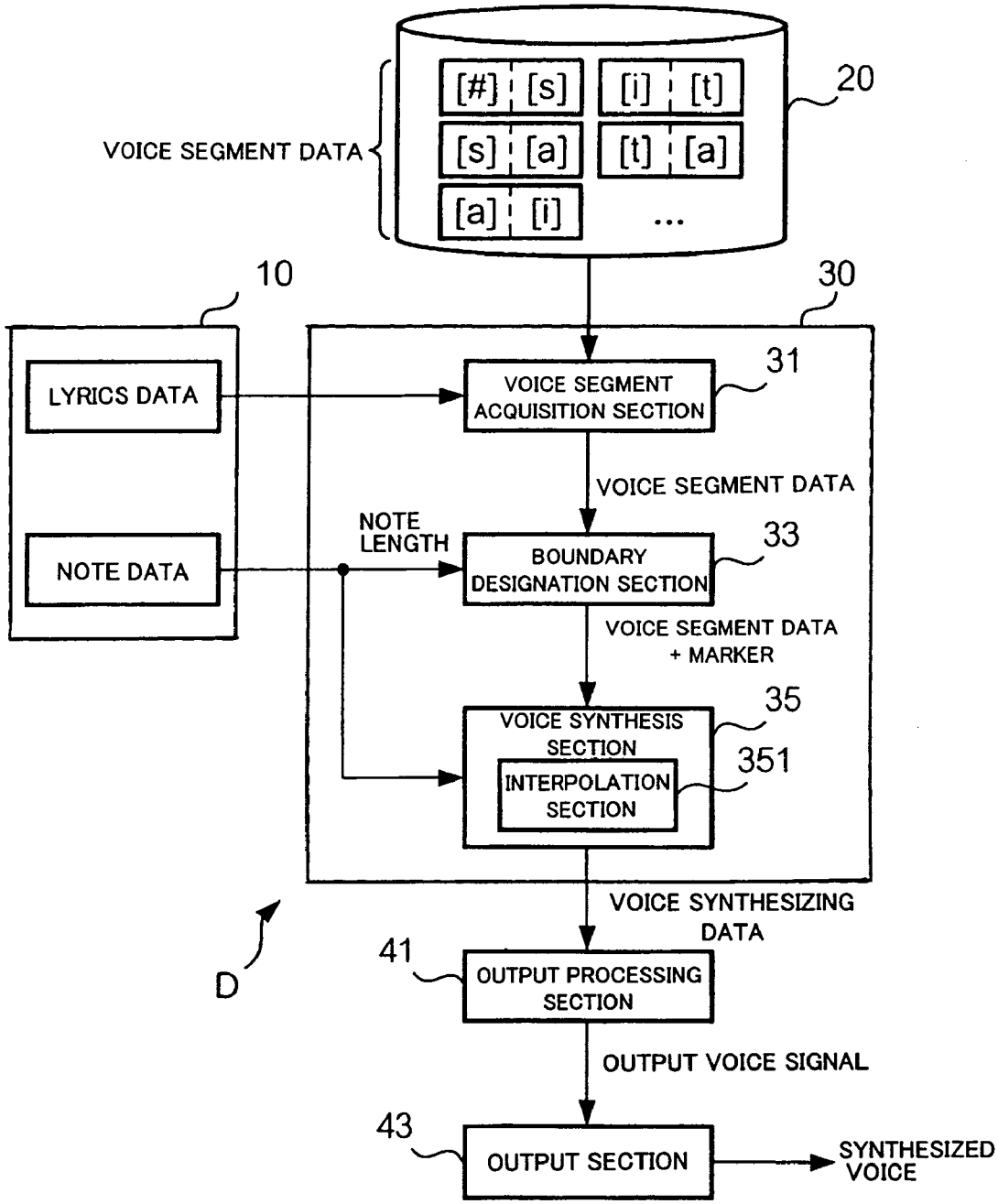
FIG. 1 is a block diagram showing a general setup of a voice synthesis apparatus in accordance with a first embodiment of the present invention.

Now, a detailed description will be made about embodiments of the present invention where the basic principles of the invention are applied to synthesis of singing voices of a music piece.

A-1. SETUP OF FIRST EMBODIMENT

First, a description will be given about a general setup of a voice synthesis apparatus in accordance with a first embodiment of the present invention, with reference to FIG. 1. As shown, the voice synthesis apparatus D includes a data acquisition section 10, a storage section 20, a voice processing section 30, an output processing section 41, and an output section 43. The data acquisition section 10, voice processing section 30 and output processing section 41 may be implemented, for example, by an arithmetic processing device, such as a CPU, executing a program, or by hardware, such as a DSP, dedicated to voice processing; the same applies to a second embodiment to be later described.

The data acquisition section 10 of FIG. 1 is a means for acquiring data related to a performance of a music piece. More specifically, the data acquisition section 10 both acquires lyric data and note data. The lyric data are a set of data indicative of a string of letters constituting the lyrics of the music piece. The note data are a set of data indicative of respective pitches of tones constituting a main melody (e.g., vocal part) of the music piece and respective duration time lengths of the tones (hereinafter referred to as "note lengths"). The lyric data and note data are, for example, data compliant with the MIDI (Musical Instrument Digital Interface) standard. Thus, the data acquisition section 10 includes a means for reading out lyric data and note data from a not-shown storage device, a MIDI interface for receiving lyric data and note data from external MIDI equipment, etc.

The storage section 20 is a means for storing data indicative of voice segments (hereinafter referred to as "voice segment data"). The storage section 20 is in the form of any of various storage devices, such as a hard disk device containing a magnetic disk and a device for driving a removable or transportable storage medium typified by a CD-ROM. In the instant embodiment, the voice segment data is indicative of frequency spectra of a voice segment, as will be later described. Procedures for creating such voice segment data will be described with primary reference to FIG. 2.

Figure 2:
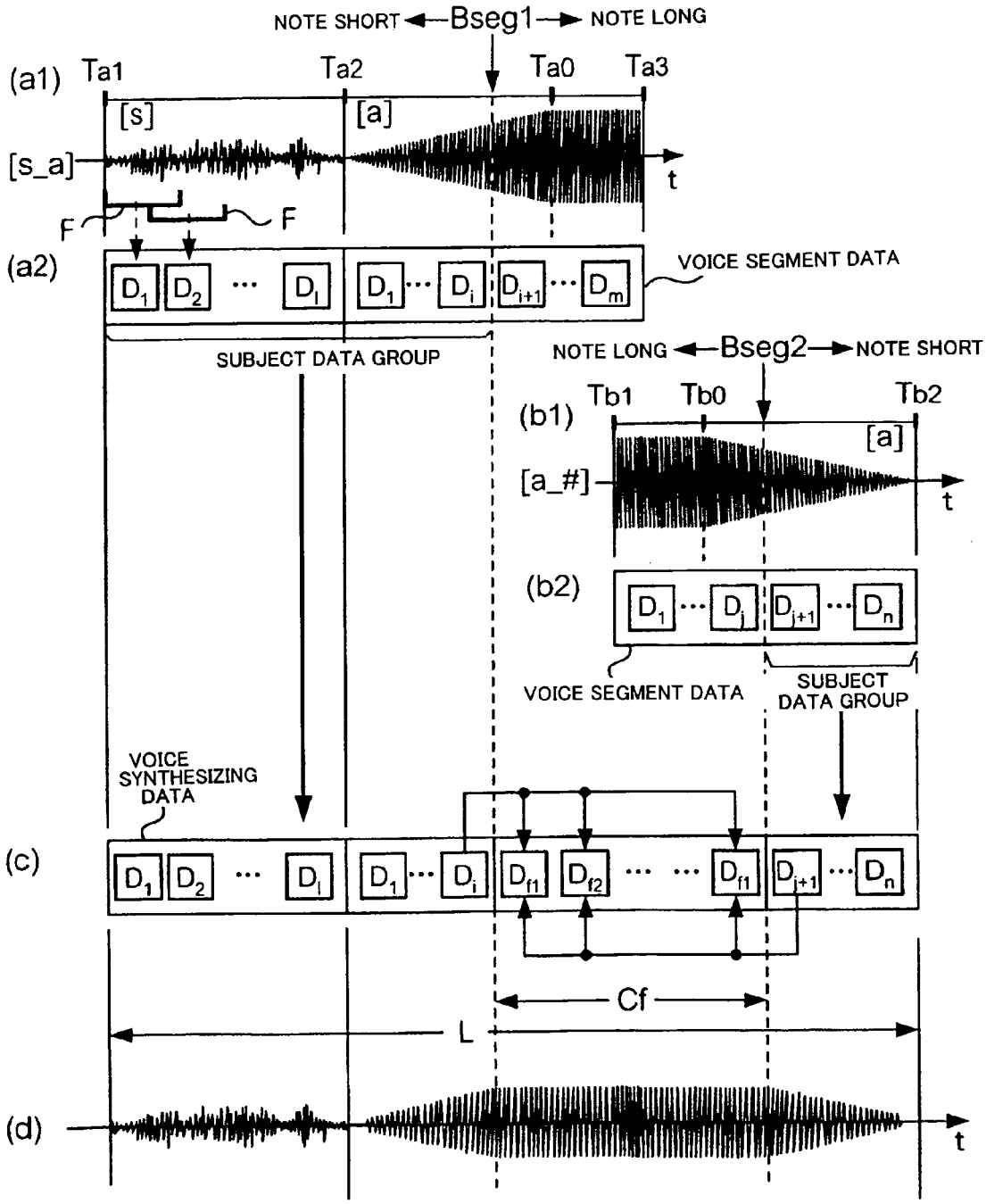
FIG. 2 is a diagram explanatory of behavior of the voice synthesis apparatus of FIG. 1.

In (a1) of FIG. 2, there is shown a waveform, on the time axis, of a voice segment where a region including an end point is a vowel phoneme (i.e., where the last phoneme is a vowel phoneme). Particularly, (a1) of FIG. 1 shows a "phoneme sequence" comprising a combination of a consonant phoneme [s] and vowel phoneme [a] following the consonant phoneme. As shown, in creating voice segment data, a region, of an input voice uttered by a particular person, corresponding to a desired voice segment is first clipped or extracted out of the input voice. End (boundary) of the region can be set by a human operator designating the end of the region by appropriately operating a predetermined operator while viewing the waveform of the input voice on a display device. In (a1) of FIG. 2, a case is assumed where time point Ta1 is designated as a start point of the phoneme [s], time point Ta3 is designated as an end point of the phoneme [a], and time point Ta2 is designated as a boundary between the consonant phoneme [s] and the vowel phoneme [a]. As shown in (a1), the waveform of the vowel phoneme [a] has a shape corresponding to behavior of the voice-uttering person gradually opening his or her mouth to utter the voice, i.e., a shape where the amplitude starts gradually increasing at time point Ta2 and is then kept substantially constant after passing time point Ta0 when the mouth has been fully opened. As the end point Ta3 of the phoneme [a] is set a time point following the transition, to the stationary state, of the waveform of the phoneme [a] (i.e., a time point later than time point Ta0 in (a1) of FIG. 2). In the following description, each boundary between a region where the waveform of a phoneme becomes stationary (i.e., where the amplitude is kept substantially constant) and a region where the waveform of the phoneme becomes unstationary (i.e., where the amplitude varies over time) will hereinafter be referred to "stationary point"; in the illustrated example of (a1) of FIG. 2, time point Ta0 is a stationary point.

In (b1) of FIG. 2, there is shown a waveform of a voice segment where a region including a start point is a vowel phoneme (i.e., where the first phoneme is a vowel phoneme). Particularly, (b1) illustrates a voice segment [a_#] containing a vowel phoneme [a]; here, '#' is a mark indicating silence. In this case, the phoneme [a] contained in the voice segment [a_#] has a waveform corresponding to behavior of a person who first starts uttering a voice with the mouth fully opened, then gradually closes the mouth and finally completely closes the mouth. Namely, the amplitude of the waveform of the phoneme [a] is initially kept substantially constant and then starts gradually decreasing at a time point (stationary point) Tb0 when the person starts closing the mouth. As a start point Tb1 of such a voice segment is set a time point within a time period when the waveform of the phoneme [a] is kept in the stationary state (i.e., a time point earlier than the stationary point Tb0.

Voice segment, having its time axial range demarcated in the above-described manner, is divided into frames F each having a predetermined time length (e.g., in a range of 5 ms to 10 ms). As seen in (a1) of FIG. 2, the frames F are set to overlap each other on the time axis. Although these frames F are each set to the same time length in the simplest form, the time length of each of the frames F may be varied in accordance with the pitch of the voice segment in question. The waveform of each of the thus-divided frames F is subjected to frequency analysis processing including an FFT (Fast Fourier Transform) process, to identify frequency spectra of the individual frames F. Data indicative of the frequency spectra of the individual frames F are stored, as voice segment data, into the storage section 20. Thus, as illustrated in (a2) and (b2) of FIG. 2, the voice segment data of each voice segment includes a plurality of unit data D (D1, D2, . . . ) indicative of frequency spectra of one of the frames F. The foregoing are the operations for creating voice segment data. In the following description, the first (leading) and last phonemes of a phoneme sequence, comprising a plurality of phonemes, will hereinafter be referred to as "front phoneme" and "rear phoneme", respectively. For example, in the voice segment [s_a], [s] is the front phoneme, while [a] is the rear phoneme.

As shown in FIG. 1, the voice processing section 30 includes a voice segment acquisition section 31, a boundary designation section 33, and a voice synthesis section 35. Lyric data acquired by the data acquisition section 10 are supplied to the voice segment acquisition section 31 and voice synthesis section 35. The voice segment acquisition section 31 is a means for acquiring voice segment data stored in the storage section 20. The voice segment acquisition section 31 in the instant embodiment sequentially selects some of the voice segment data stored in the storage section 20 on the basis of the lyric data, and then it reads out and outputs the selected voice segment data to the boundary designation section 33. More specifically, the voice segment acquisition section 31 reads out, from the storage section 20, the voice segment data corresponding to the letters designated by the lyric data. For example, when a string of letters, "saita", has been designated by the lyric data, the voice segment data corresponding to the voice segments, [#s], [s_a], [a_i], [t_a] and [a#], are sequentially read out from the storage section 20.

The boundary designation section 33 is a means for designating a boundary (hereinafter referred to as "phoneme segmentation boundary") Bseg in the voice segments acquired by the voice segment acquisition section 31. As seen in (a1) and (a2) or (b1) and (b2) of FIG. 2, the boundary designation section 33 in the instant embodiment designates, as a phoneme segmentation boundary Bseg (e.g., Bseg1, Bseg2), a time point corresponding to the note length, designated by the note data, in a region from the start point (Ta2, Tb1) to the end point (Ta3, Tb2) of the vowel phoneme in the voice segment indicated by the voice segment data. Namely, the position of the phoneme segmentation boundary Bseg varies depending on the note length. Further, for the voice segment comprising a plurality of vowels (e.g., [a_i]), a phoneme segmentation boundary Bseg (e.g., Bseg1, Bseg2) is designated for each of the vowel phonemes. Once the boundary designation section 33 designates the phoneme segmentation boundary Bseg (e.g., Bseg1, Bseg2), it adds data indicative of the position of the phoneme segmentation boundary Bseg (hereinafter referred to as "marker") to the voice segment data supplied from the voice segment acquisition section 31 and then outputs the thus-marked voice segment data to the voice synthesis section 35. Specific behavior of the boundary designation section 33 will be later described in greater detail.

The voice synthesis section 35 shown in FIG. 1 is a means for connecting together a plurality of voice segments. In the instant embodiment, some of the unit data D are extracted from the individual voice segment data sequentially supplied by the boundary designation section 33 (hereinafter, each group of unit data D extracted from one voice segment data will hereinafter be referred to as "subject data group"), and a voice is synthesized by connecting together the subject data groups of adjoining or successive voice segment data. Of the voice segment data, a boundary between the subject data group and the other unit data D is the above-mentioned phoneme segmentation boundary Bseg. Namely, as seen in (a2) and (b2) of FIG. 2, the voice synthesis section 35 extracts, as a subject data group, individual unit data D belonging to a region divided from one voice segment data by the phoneme segmentation boundary Bseg.

Sometimes, merely connecting together a plurality of voice segments can not provide a desired note length. Further, if voice segments of different tone colors are connected, there is a possibility of noise unpleasant to the ear being produced in a connection between the voice segments. To avoid such inconveniences, the voice synthesis section 35 in the instant embodiment includes an interpolation section 351 that is a means for filling or interpolating a gap Cf between the voice segments. For example, the interpolation section 351, as shown in (c) of FIG. 2, generates interpolating unit data Df (Df1, Df2, . . . , Dfl) on the basis of unit data Di included in the voice segment data of the voice segment [s_a] and unit data Dj+1 included in the voice segment data of the voice segment [a_#]. The total number of the interpolating unit data Df is chosen in accordance with the note length L indicated by the note data. Namely, if the note length is long, a relatively great number of interpolating unit data Df are generated, while, if the note length is short, a relatively small number of interpolating unit data Df are generated. The thus-generated interpolating unit data Df are inserted in the gap Gf between the subject data groups of the individual voice segments, so that the note length of a synthesized voice can be adjusted to the desired time length L. Further, by the gap Cf between the individual voice segments being smoothly filled with the interpolating unit data Df, it is possible to reduce unwanted noise that would be produced in the connection between the voice segments. Further, the voice synthesis section 35 adjusts the pitch of the voice, indicated by the subject data groups interconnected via the interpolating unit data Df, into the pitch designated by the note data. In the following description, the data generated through various processes (i.e., voice segment connection, interpolation and pitch conversion) by the voice synthesis section 35 will hereinafter be referred to as "voice synthesizing data". As seen in (c) of FIG. 2, the voice synthesizing data are a string of data comprising the subject data groups extracted from the individual voice segments and the interpolating unit data Df inserted in the gap between the subject data groups.

Further, the output processing section 41 shown in FIG. 1 generates a time-domain signal by performing an inverse FFT process on the unit data D (including the interpolating unit data Df) of the individual frames F that constitute the voice synthesizing data output from the voice synthesis section 35. The output processing section 41 also multiplies the time-domain signal of each frame F by a time window function and connects together the resultant signals in such a manner as to overlap each other on the time axis. The output section 43 includes a D/A converter for converting an output voice signal, supplied from the output processing section 41, into an analog electric signal, and a device (e.g., speaker or headphones) for generating an audible sound based on the output signal from the D/A converter.

A-2. BEHAVIOR OF FIRST EMBODIMENT

Next, a description will be given about the embodiment of the voice synthesis apparatus D.

The voice segment acquisition section 31 of the voice processing section 30 sequentially reads out voice segment data, corresponding to lyric data supplied from the data acquisition section 10, from the storage section 20 and outputs the thus read-out voice segment data to the boundary designation section 33. Here, let it be assumed that letters "sa" have been designated by the lyric data. In this case, the voice segment acquisition section 31 reads out, from the storage section 20, voice segment data corresponding to voice segments, [#_s], [s_a] and [a_#], and outputs the read-out voice segment data to the boundary designation section 33 in the order mentioned.

Figure 4:
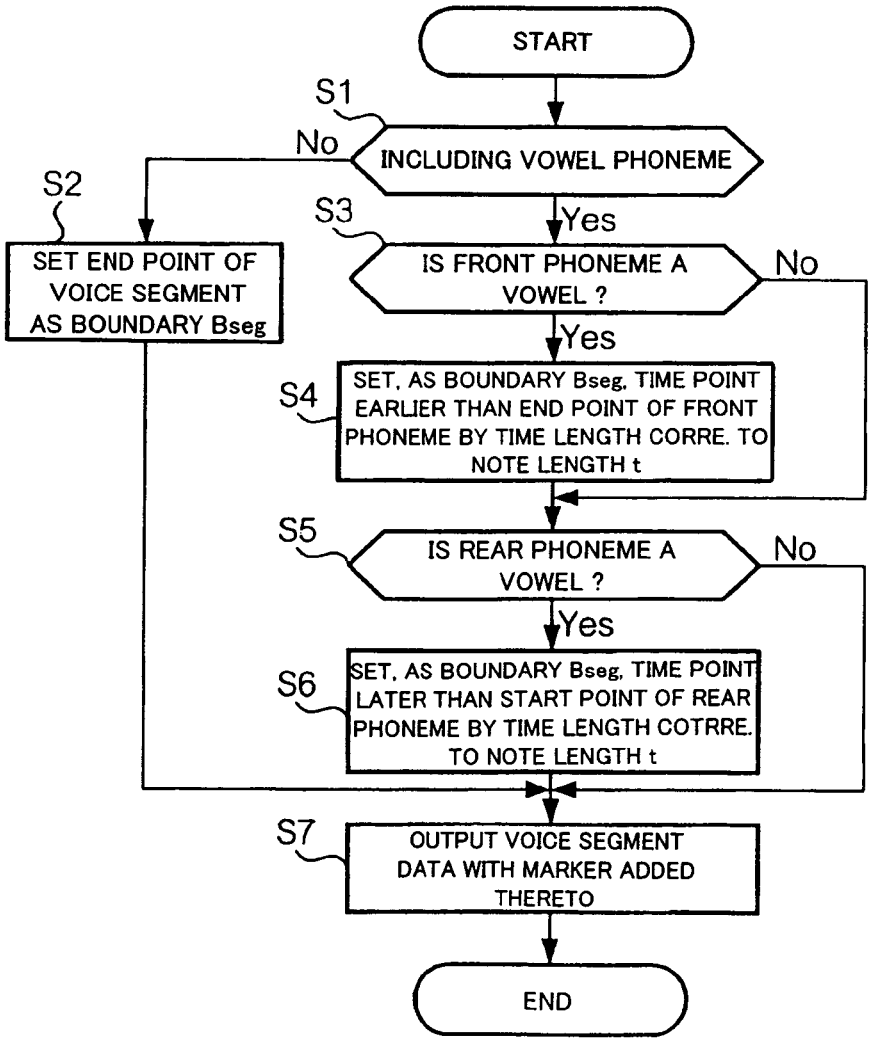
FIG. 4 is a flow chart showing operations performed by a boundary designation section in the voice synthesis apparatus of FIG. 1.

In turn, the boundary designation section 33 designates phoneme segmentation boundaries Bseg for the voice segment data sequentially supplied from the voice segment acquisition section 31. FIG. 4 is a flow chart showing an example sequence of operations performed by the boundary designation section 33 each time voice segment data has been supplied from the voice segment acquisition section 31. As shown in FIG. 4, the voice processing section 30 first determines, at step S1, whether the voice segment indicated by the voice segment data supplied from the voice segment acquisition section 31 includes a vowel phoneme. The determination as to whether or not the voice segment includes a vowel phoneme may be made in any desired manner; for example, a flag indicative of presence/absence of a vowel phoneme may be added in advance to each voice segment data stored in the storage section 20 so that the boundary designation section 33 can make the determination on the basis of the flag. If the voice segment does not include any vowel phoneme as determined at step S1, the voice processing section 30 designates the end point of that voice segment as a phoneme segmentation boundary Bseg, at step S2. For example, when the voice segment data of the voice segment [#_s] has been supplied from the voice segment acquisition section 31, the boundary designation section 33 designates the end point of that voice segment [#_s] as a phoneme segmentation boundary Bseg. Thus, for the voice segment [#_s], all of the unit data D constituting the voice segment data are set as a subject data group by the voice synthesis section 35.

If, on the other hand, the voice segment includes a vowel phoneme as determined at step S1, the boundary designation section 33 makes a determination, at step S3, as to whether the front phoneme of the voice segment indicated by the voice segment data is a vowel phoneme. If answered in the affirmative at step S3, the boundary designation section 33 designates, at step S4, a phoneme segmentation boundary Bseg such that the time length from the end point of the vowel phoneme, as the front phoneme, of the voice segment to the phoneme segmentation boundary Bseg corresponds to the note length indicated by the note data. For example, the voice segment [a_#] to be used for synthesizing the voice "sa" has a vowel as the front phoneme, and thus, when the voice segment data indicative of the voice segment [a_#] has been supplied from the voice segment acquisition section 31, the boundary designation section 33 designates a phoneme segmentation boundary Bseg through the operation of step S4. Specifically, with a longer note length, an earlier time point on the time axis, i.e. earlier than the end point Tb2 of the vowel phoneme [a], is designated as a phoneme segmentation boundary Bseg, as shown in (b1) and (b2) of FIG. 2. If, on the other hand, the front phoneme of the voice segment indicated by the voice segment data is not a vowel phoneme as determined at step S3, the boundary designation section 33 jumps over step S4 to step S5.

Figures 5, 6:
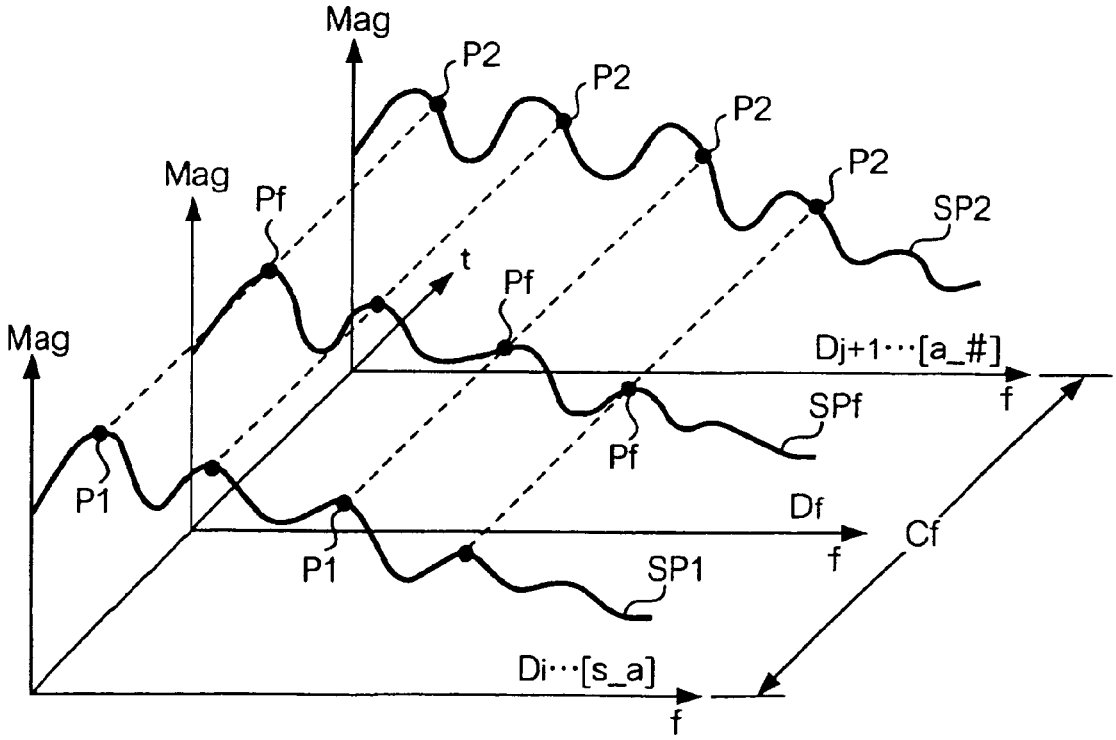
FIG. 5 is a table showing positional relationship between a note length and a phoneme segmentation boundary.
FIG. 6 is a diagram explanatory of an interpolation operation by an interpolation section in the voice synthesis apparatus of FIG. 1.

FIG. 5 is a table showing example positional relationship between the time length t indicated by the note data and the phoneme segmentation boundary Bseg. As shown, if the time length t indicated by the note data is below 50 ms, a time point five ms earlier than the end point of the vowel as the front phoneme (time point Tb2 indicated in (b1) of FIG. 2) is designated as a phoneme segmentation boundary Bseg. The reason why there is provided a lower limit to the time length from the end point of the front phoneme to the phoneme segmentation boundary Bseg is that, if the time length of the vowel phoneme is too short (e.g., less than five ms), little of the vowel phoneme is reflected in a synthesized voice. If, on the other, the time length t indicated by the note data is over 50 ms, a time point earlier by {(t−40)/2} ms than the end point of the vowel phoneme as the front phoneme is designated as a phoneme segmentation boundary Bseg. Therefore, in the case where the note length t is over 50 ms, the longer the note length t, the earlier time point on the time axis is set as a phoneme segmentation boundary Bseg; in other words, with a shorter note length t, a phoneme segmentation boundary Bseg is set at a later time point on the time axis. (b1) and (b2) of FIG. 2 show a case where a time point later than the stationary point Tb0 in the front phoneme [a] of the voice segment [a_#] is designated as a phoneme segmentation boundary Bseg. If the phoneme segmentation boundary Bseg desinated on the basis of the table illustrated in FIG. 5 precedes the start point Tb1 of the front phoneme, then the start point Tb1 is set as a phoneme segmentation boundary Bseg.

Then, the boundary designation section 33 determines, at step S5, whether the rear phoneme of the voice segment indicated by the voice segment data is a vowel. If answered in the negative, the boundary designation section 33 jumps over step S6 to step S7. If, on the other hand, the rear phoneme of the voice segment indicated by the voice segment data is a vowel as determined at step S5, the boundary designation section 33 designates, at step S6, a phoneme segmentation boundary Bseg such that the time length from the start point of the vowel as the rear phoneme of the voice segment to the phoneme segmentation boundary Bseg corresponds to the note length indicated by the note data. For example, the voice segment [s_a] to be used for synthesizing the voice "sa" has a vowel as the rear phoneme, and thus, when the voice segment data indicative of the voice segment [s_a] has been supplied from the voice segment acquisition section 31, the boundary designation section 33 designates a phoneme segmentation boundary Bseg through the operation of step S6. Specifically, with a longer note length, a later time point on the time axis, i.e. later than the start point Ta2 of the rear phoneme [a], is designated as a phoneme segmentation boundary Bseg, as shown in (a1) and (a2) of FIG. 2. In this case too, the position of the phoneme segmentation boundary is set on the basis of the table of FIG. 5. Namely, if the time length t indicated by the note data is below 50 ms, a time point five ms later than the start point of the vowel as the rear phoneme (time point Ta2 indicated in (a1) of FIG. 2) is designated as a phoneme segmentation boundary Bseg. If, on the other hand, the note length t indicated by the note data is over 50 ms, a time point later by {(t−40)/2} ms than the start point of the vowel as the rear phoneme is designated as a phoneme segmentation boundary Bseg. Therefore, in the case where the note length t is over 50 ms, the longer the note length t, the later time point on the time axis is set as a phoneme segmentation boundary Bseg; in other words, with a shorter note length t, a phoneme segmentation boundary Bseg is set at an earlier time point on the time axis. (a1) and (a2) of FIG. 2 show a case where a time point earlier than the stationary point Ta0 in the rear phoneme [a] of the voice segment [s_a] is designated as a phoneme segmentation boundary Bseg. If the phoneme segmentation boundary Bseg designated on the basis of the table illustrated in FIG. 5 succeeds the end point Ta3 of the rear phoneme, then the end point Ta3 is set as a phoneme segmentation boundary Bseg.

Figure 3:
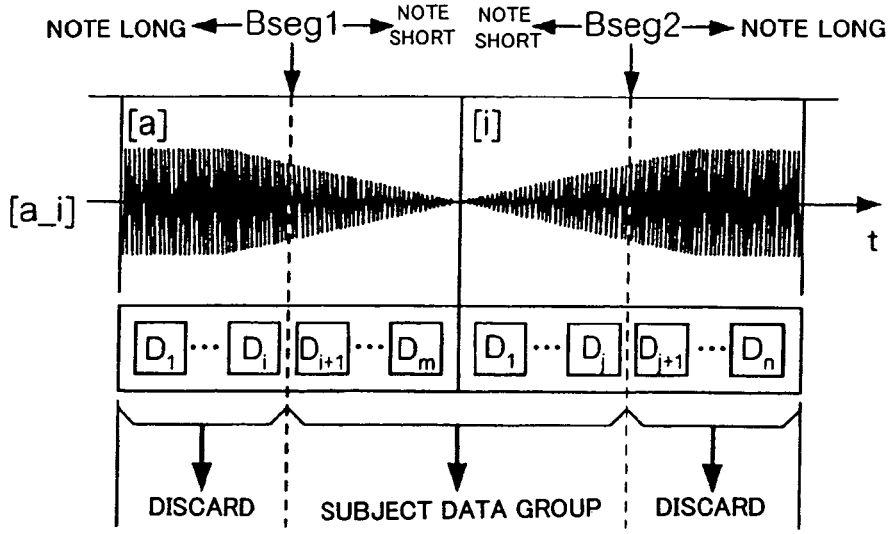
FIG. 3 is also a diagram explanatory of the behavior of the voice synthesis apparatus of FIG. 1.

Once the boundary designation section 33 designates the phoneme segmentation boundary Bseg through the above-described procedures, it adds a marker, indicative of the position of the phoneme segmentation boundary Bseg, to the voice segment data and then outputs the thus-marked voice segment data to the voice synthesis section 35, at step S7. Note that, for each voice segment where the front and rear phonemes are each a vowel (e.g., [a_i]), both of the operations at steps S4 and S6 are carried out. Thus, for such a type of voice segment, a phoneme segmentation boundary Bseg (e.g., Bseg1, Bseg2) is designated for each of the front and rear phonemes, as illustrated in FIG. 3. The foregoing are the detailed contents of the operations performed by the boundary designation section 33.

Then, the voice synthesis section 35 connects together the plurality of voice segments to generate voice synthesizing data. Namely, the voice synthesis section 35 first selects a subject data group from the voice segment data supplied from the boundary designation section 33. The way to select the subject data groups will be described in detail individually for a case where the supplied voice segment data represents a voice segment including no vowel, a case where the supplied voice segment data represents a voice segment whose front phoneme is a vowel, and a case where the supplied voice segment data represents a voice segment whose rear phoneme is a vowel.

For the voice segment including no vowel, the end point of the voice segment is set, at step S2 of FIG. 4, as a phoneme segmentation boundary Bseg. Thus, once such a voice segment is supplied, the voice synthesis section 35 selects, as a subject data group, all of the unit data D included in the supplied voice segment data. Even where the voice segment indicated by the supplied voice segment data includes a vowel, the voice synthesis section 35 selects, as a subject data group, all of the unit data D included in the supplied voice segment data similarly to the above-described, on condition that the start or end point of each of the phonemes has been set as a phoneme segmentation boundary Bseg. If an intermediate (i.e., along-the-way) time point of a voice segment including a vowel has been set as a phoneme segmentation boundary Bseg, some of the unit data D included in the supplied voice segment data are selected as a subject data group.

Namely, once the voice segment data of the voice segment, where the rear phoneme is a vowel, is supplied along with the marker, the voice synthesis section 35 extracts, as a subject data group, the unit data D belonging to a region that precedes the phoneme segmentation boundary Bseg indicated by the marker. Now consider a case where voice segment data, including unit data D1 to Dl corresponding to a front phoneme [s] and unit data D1 to Dm corresponding to a rear phoneme [a] (vowel phoneme) as illustratively shown in (a2) of FIG. 2, has been supplied. In this case, the voice synthesis section 35 identifies, from among the unit data D1 to Dm of the rear phoneme [a], the unit data Di corresponding to a frame F immediately preceding a phoneme segmentation boundary Bseg, and then it extracts, as a subject data group, the first unit data D1 (i.e., the unit data corresponding to the first frame F of the phoneme [s])) to the unit data Di of the voice segment [s_a]. The unit data Di+1 to Dm, belonging to a region from the phoneme segmentation boundary Bseg1 to the end point of the voice segment are discarded. As a result of such operations, the individual unit data representative of a waveform of the region preceding the phoneme segmentation boundary Bseg1, within an overall waveform across all the regions of the voice segment [s_a] shown in (a1) of FIG. 2, are extracted as a subject data group. Assuming that the phoneme segmentation boundary Bseg1 has been designated at a time point of the phoneme [a] preceding the stationary point Ta0 as illustrated in (a1) of FIG. 2, the waveform, supplied by the voice synthesis section 35 for the subsequent voice synthesis processing, corresponds to the waveform of the rear phoneme [a] before reaching the stationary state. In other words, the waveform of a region of the rear phoneme [a], having reached the stationary state, is not supplied for the subsequent voice synthesis processing.

Once the voice segment data of the voice segment, where the front phoneme is a vowel, is supplied along with the marker, the voice synthesis section 35 extracts, as a subject data group, the unit data D belonging to a region that succeeds the phoneme segmentation boundary Bseg indicated by the marker. Now consider a case where voice segment data, including unit data D1 to Dn corresponding to a front phoneme [a] of a voice segment [a_#] as illustratively shown in (b2) of FIG. 2, has been supplied. In this case, the voice synthesis section 35 identifies, from among the unit data D1 to Dn of the front phoneme [a], the unit data Dj+1 corresponding to a frame F immediately succeeding a phoneme segmentation boundary Bseg2, and then it extracts, as a subject data group, the unit data Dj+1 to the last unit data Dn of the front phoneme [a]. The unit data D1 to Dj, belonging to a region from the start point of the voice segment (i.e., the start point of the first phoneme [a]) to the phoneme segmentation boundary Bseg1 are discarded. As a result of such operations, the unit data representative of a waveform of the region succeeding the phoneme segmentation boundary Bseg2, within an overall waveform across all the regions of the voice segment [a_#] shown in (b1) of FIG. 2, are extracted as a subject data group. In this case, the waveform, supplied by the voice synthesis section 35 for the subsequent voice synthesis processing, corresponds to the waveform of the phoneme [a] after having shifted from the stationary state to the unstationay state. In other words, the waveform of a region of the front phoneme [a], where the stationary state is maintained, is not supplied for the subsequent voice synthesis processing.

Further, for the voice segment where the front and rear phonemes are each a vowel, unit data D belonging to a region from a phoneme segmentation boundary Bseg, designated for the front phoneme, to the end point of the front phoneme and unit data D belonging to a region from the start point of the rear phoneme to a phoneme segmentation boundary Bseg designated for the rear phoneme are extracted as a subject data group. For example, for a voice segment [a_i] comprising a combination of the front and rear phonemes [a] and [i] that are each a vowel as illustratively shown in FIG. 3, unit data D (Di+1 to Dm, and D1 to Dj), belonging to a region from a phoneme segmentation boundary Bseg1 designated for the front phoneme [a], to a phoneme segmentation boundary Bseg2 designated for the rear phoneme [i], are extracted as a subject data group, and the other unit data are discarded.

Once the subject data groups of successive voice segments are designated through the above-described operations, the interpolation section 351 of the voice synthesis section 35 generates interpolating unit data Df for filling a gap Cf between the voice segments. More specifically, the interpolation section 351 generates interpolating unit data Df through linear interpolation using the last unit data D in the subject data group of the preceding voice segment and the first unit data D in the subject data group of the succeeding voice segment. In a case where the voice segments [s_a] and [a_#] are to be interconnected as shown in FIG. 2, interpolating unit data Df1 to Dfl are generated on the basis of the last unit data Di of the subject data group extracted for the voice segment [s_a] and the first unit data Dj+1 of the subject data group extracted for the voice segment [a_#]. FIG. 6 shows, on the time axis, frequency spectra SP1 indicated by the last unit data Di of the subject data group of the voice segment [s_a] and frequency spectra SP2 indicated by the first unit data Dj+1 of the subject data group of the voice segment [a_#]. As shown in the figure, a frequency spectrum SPf indicated by the interpolating unit data Df takes a shape defined by connecting predetermined points Pf on liner lines connecting between points P1 of the frequency spectra SP1 of individual ones of a plurality of frequencies on a frequency axis (f) and predetermined points P2 of the frequency spectra SP2 of these frequencies. Although only one interpolating unit data Df is shown in FIG. 6 for simplicity, a predetermined number of the interpolating unit data Df (Df1, Df2, . . . , Dfl), corresponding to a note length indicated by note data, are sequentially created in a similar manner. With the interpolation operation, the subject data group of the voice segment [s_a] and the subject data group of the voice segment [a_#] are interconnected via the interpolating unit data Df and the time length L from the first unit data D1 of the subject data group of the voice segment [s_a] to the last unit data Dn of the subject data group of the voice segment [a_#] is adjusted in accordance with the note length, as seen in (c) of FIG. 2.

Then, the voice synthesis section 35 performs predetermined operations on the individual unit data generated by the interpolation operation (including the interpolating unit data Df), to generate voice synthesizing data. The predetermined operations performed here include an operation for adjusting a voice pitch, indicated by the individual unit data D, into a pitch designated by the note data. The pitch adjustment may be performed using any one of the conventionally-known schemes. For example, the pitch may be adjusted by displacing the frequency spectra, indicated by the individual unit data D, along the frequency axis by an amount corresponding to the pitch designated by the note data. Further, the voice synthesis section 35 may perform an operation for imparting any of various effects to the voice represented by the voice synthesizing data. For example, when the note length is relatively long, slight fluctuation or vibrato may be imparted to the voice represented by the voice synthesizing data. The voice synthesizing data generated in the above-described manner is output to the output processing section 41. The output processing section 41 outputs the voice synthesizing data after converting the data into an output voice signal of the time domain.

As set forth above, the instant embodiment can vary the position of the phoneme segmentation boundary Bseg that defines a region of a voice segment to be supplied for the subsequent voice synthesis processing. Thus, as compared to the conventional technique where a voice is synthesized merely on the basis of an entire region of a voice segment, the present invention can synthesize diversified and natural voices. For example, when a time point, of a vowel phoneme included in a voice segment, before a waveform reaches a stationary state, has been designated as a phoneme segmentation boundary Bseg, it is possible to synthesize a voice imitative of a real voice uttered by a person without sufficiently opening the mouth. Further, because a phoneme segmentation boundary Bseg can be variably designated for one voice segment, there is no need to prepare a multiplicity of voice segment data with different regions (e.g., a multiplicity of voice segment data corresponding to various different opening degree of the mouth of a person).

In many cases, lyrics of a music piece where each tone has a relatively short note length vary at a high pace. It is necessary for a singer of such a music piece to sing at high speed, e.g. by uttering a next word before sufficiently opening his or her mouth to utter a given word. On the basis of such a tendency, the instant embodiment is arranged to designate a phoneme segmentation boundary Bseg in accordance with a note length of each tone constituting a music piece. Where each tone has a relatively short note length, such arrangements of the invention allow a synthesized voice to be generated using a region of each voice segment whose waveform has not yet reached a stationary state, so that it is possible to synthesize a voice imitative of a real voice uttered by a person (singing person) as the person sings at high speed without sufficiently opening his or her mouth. Where each tone has a relatively long note length, on the other hand, the arrangements of the invention allow a synthesized voice to be generated by also using a region of each voice segment whose waveform has reached the stationary state, so that it is possible to synthesize a voice imitative of a real voice uttered by a person as the person sings with his or her mouth sufficiently opened. Thus, the instant embodiment can synthesize natural singing voices corresponding to a music piece.

Further, according to the instant embodiment, a voice is synthesized on the basis of both a region, of a voice segment whose rear phoneme is a vowel, extending up to an intermediate or along-the-way point of the vowel and a region, of another voice segment whose front phoneme is a vowel, extending from an along-the-way point of the vowel. As compared to the technique where a phoneme segmentation boundary Bseg is designated for only one voice segment, the inventive arrangements can reduce differences between characteristics at and near the end point of a preceding voice segment and characteristics at and near the start point of a succeeding voice segment, so that the successive voice segments can be smoothly interconnected to synthesize a natural voice.

B. SECOND EMBODIMENT

Next, a description will be made about a voice synthesis apparatus D in accordance with a second embodiment of the present invention, with reference FIG. 7. The first embodiment has been described above as controlling a position of a phoneme segmentation boundary D in accordance with a note length of each tone constituting a music piece. By contrast, the second embodiment of the voice synthesis apparatus D is arranged to designate a position of a phoneme segmentation boundary in accordance with a parameter input via the user. Note that the same elements as in the first embodiment will be indicated by the same reference characters as in the first embodiment and will not be described to avoid unnecessary duplication.

Figure 7:
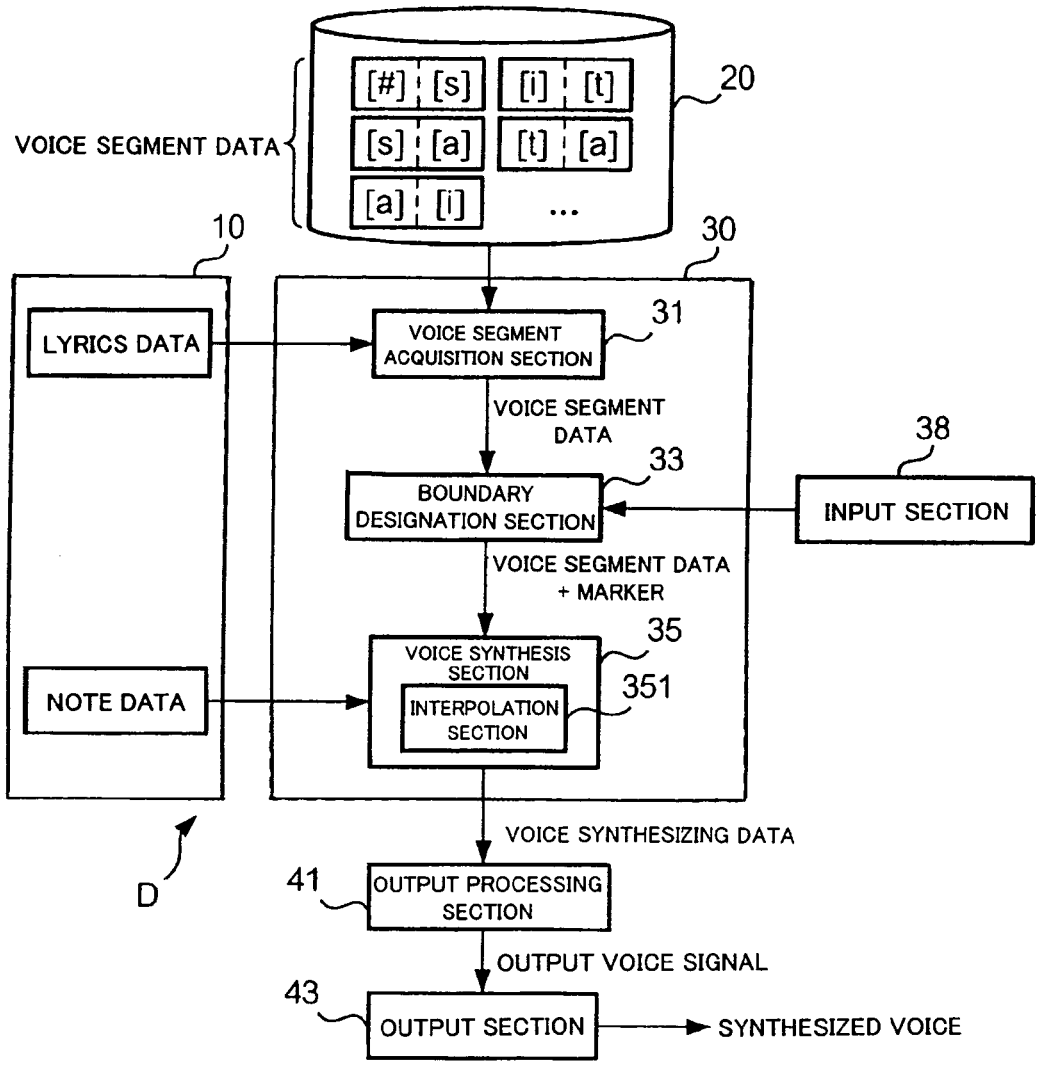
FIG. 7 is a block diagram showing a general setup of a voice synthesis apparatus in accordance with a second embodiment of the present invention.
Figure 8:
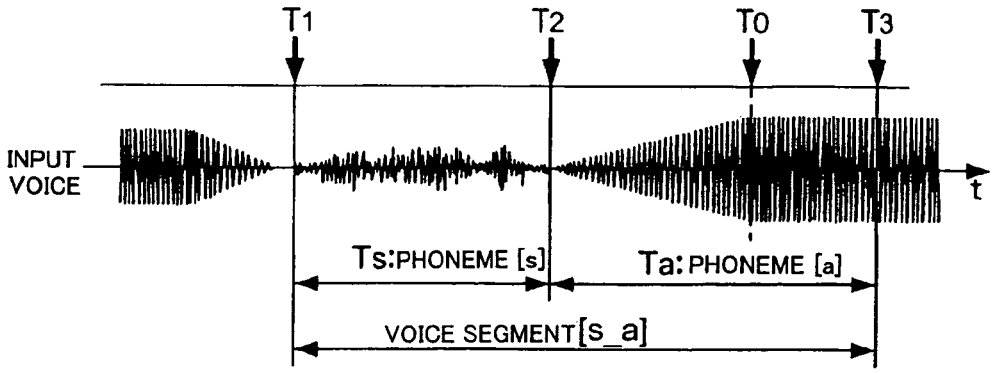
(PRIOR ART) FIG. 8
FIG. 8 is a time chart explanatory of behavior of a conventional voice synthesis apparatus.

As shown in FIG. 7, the second embodiment of the voice synthesis apparatus D includes an input section 38 in addition to the various components as described above in relation to the first embodiment. The input section 38 is a means for receiving parameters input via the user. Each parameter into to the input section 38 is supplied to the boundary designation section 33. The input section 38 may be in the form of any of various input devices including a plurality of operators operable by the user. Note data output from the data acquisition section 10 are supplied onto the voice synthesis section 35, but not to the boundary designation section 33.

Once voice segment data is supplied to the voice segment acquisition section 31 in the voice synthesis apparatus D, a time point, in a vowel of the voice segment indicated by the supplied voice segment data, corresponding to a parameter input via the input section 38, is designated as a phoneme segmentation boundary Bseg. More specifically, at step S4 of FIG. 4, the boundary designation section 33 designates, as a phoneme segmentation boundary Bseg, a time point earlier than (i.e., going back from) the end point (Tb2) of the front phoneme by a time length corresponding to the input parameter. For example, with a greater parameter value input by the user, an earlier time point on the time axis (i.e., going backward away from the end point (Tb2) of the front phoneme) is designated as a phoneme segmentation boundary Bseg. At step S6 of FIG. 4, the boundary designation section 33 designates, as a phoneme segmentation boundary Bseg, a time point later than the start point (Ta2) of the rear phoneme by a time length corresponding to the input parameter. For example, with a greater parameter value input by the user, a later time point on the time axis (i.e., going forward away from the start point (Ta2) of the rear phoneme) is designated as a phoneme segmentation boundary Bseg. The other part of the behavior of the second embodiment than the above-described is similar to that of the first embodiment.

The second embodiment too allows the position of the phoneme segmentation boundary Bseg to be variable and thus can achieve the same benefits as the first embodiment; that is, the second embodiment too can synthesize a variety of voices without having to increase the number of voice segments. Further, because the position of the phoneme segmentation boundary Bseg can be controlled in accordance with a parameter input by the user, a variety of voices can be synthesized with users intent precisely reflected therein. For example, there is a singing style where a singer sings without sufficiently opening the mouth at an initial stage immediately after a start of a music piece performance and then increases opening degree of the mouth as the tune rises or livens up. The instant embodiment can reproduce such a singing style by varying the parameter in accordance with progression of a music piece performance.

C. MODIFICATION

The above-described embodiments may be modified variously as explained by way of example below, and the modifications to be explained may be combined as necessary.

(1) The arrangements of the above-described first and second embodiments may be used in combination. Namely, the position of the phoneme segmentation boundary Bseg may be controlled in accordance with both a note length designated by note data and a parameter input via the input section 38. However, the position of the phoneme segmentation boundary Bseg may be controlled in any desired manner; for example, it may be controlled in accordance with a tempo of a music piece. Namely, for a voice segment where the front phoneme is a vowel, the faster the tempo of a music piece, the later time point on the time axis is designated as a phoneme segmentation boundary Bseg, while, for a voice segment where the rear phoneme is a vowel, the faster the tempo of a music piece, the earlier time point on the time axis is designated as a phoneme segmentation boundary Bseg. Further, data indicative of a position of a phoneme segmentation boundary Bseg may be provided in advance for each tone of a music piece so that the boundary designation section 33 designates a phoneme segmentation boundary Bseg on the basis of the data. Namely, in the present invention, it is only necessary that the phoneme segmentation boundary Bseg to be designated in a vowel phoneme be variable in position, and each phoneme segmentation boundary Bseg may be designated in any desired manner.

(2) In the above-described embodiments, the boundary designation section 33 outputs voice segment data to the voice synthesis section 35 after attaching the above-mentioned marker to the segment data, and the voice synthesis section 35 discards unit data D other than a selected subject data group. In an alternative, the boundary designation section 33 may discard the unit data D other than the selected subject data group. Namely, in the alternative, the boundary designation section 33 extracts the subject data group from the voice segment data on the basis of a phoneme segmentation boundary Bseg, and then supplies the extracted subject data to the sound synthesis section 35, discarding the other unit data D than the subject data group. Such inventive arrangements can eliminate the need for attaching the marker to the voice segment data.

(3) Form of the voice segment data may be other than the above-described. For example, data indicative of spectral envelopes of individual frames F of each voice segment may be stored and used as voice segment data. In another alternative, data indicative of a waveform, on the time axis, of each voice segment may be stored and used as voice segment data. In another alternative, the waveform of the voice segment may be divided, by the SMS (Spectral Modeling Synthesis) technique, into a deterministic component and stochastic component, and data indicative of the individual components may be stored and used as voice segment data. In this case, both of the deterministic component and stochastic component are subjected to various operations by the boundary designation section 33 and voice synthesis section 35, and the thus-processed deterministic and stochastic components are added together by an adder provided at a stage following the voice synthesis section 35. Alternatively, after each voice segment is divided into frames F, amounts of a plurality of characters related to spectral envelopes of the individual divided frames F of the voice segment, such as frequencies and gains at peaks of the spectral envelopes or overall inclinations of the spectral envelopes, may be extracted so that a set of parameters indicative of these amounts of characters is stored and used as voice segment data. Namely, in the present invention, the voice segments may be stored or retained in any desired form.

(4) Whereas the embodiments have been described as including the interpolation section 351 for interpolating a gap Cf between voice segments, such interpolation is not necessary essential. For example, there may be prepared a voice segment [a] to be inserted between voice segments [s_a] and [a_#], and the time length of the voice segment [a] may be adjusted in accordance with a note length so as to adjust a synthesized voice. Further, although the embodiments have been described as linearly interpolating a gap Cf between voice segments, the interpolation may be performed in any other desired manner. For example, curve interpolation, such as spline interpolation, may be performed. In another alternative, interpolation is performed on extracted parameters indicative of spectral envelope shapes (e.g., spectral envelopes and inclinations) of voice segments.

(5) The first embodiment has been described above as designating phoneme segmentation boundaries Bseg for both a voice segment where the front phoneme is a vowel and a voice segment where the rear phoneme is a vowel on the basis of the same or common mathematical expression ({(t−40)/2}). The way to designate the phoneme segmentation boundaries Bseg may differ between two such voice segments.

(6) Further, whereas the embodiments have been described as applied to an apparatus for synthesize singing voices, the basic principles of the invention is of course applicable to any other apparatus. For example, the present invention may be applied to an apparatus which reads out a string of letters on the basis of document data (e.g., text file). Namely, the voice segment acquisition section 31 may read out voice segment data from the storage section 20, on the basis of letter codes included in the text file, so that a voice is synthesized on the basis of the read-out out voice segment data. This type of apparatus can not use the factor "note length" to designate a phoneme segmentation boundary Bseg unlike in the case where a singing voice of a music piece is synthesized; however, if data designating a duration time length of each letter is prepared in advance in association with the document data, the apparatus can control the phoneme segmentation boundary Bseg in accordance with the time length indicated by the data. The "time data" used in the context of the present invention represents a concept embracing all types of data designating duration time lengths of voices, including not only data ("note data" in the above-described first embodiment) designating note lengths of tones constituting a music piece and sounding times of letters as explained in the modified examples. Note that, in the above-described document reading apparatus too, there may be employed arrangements for controlling the position of the phoneme segmentation boundary Bseg on the basis of a user-input parameter, as in the second embodiment.

What is claimed is:

1. A voice synthesis apparatus comprising:

a voice segment acquisition section that acquires a voice segment including one or more phonemes;

a boundary designation section that designates a boundary intermediate between start and end positions of a vowel phoneme included in the voice segment acquired by the voice segment acquisition section, wherein when the acquired voice segment where a region including an end point is a vowel phoneme, the boundary designation section designates, as the boundary, a time point earlier than a stationary point, which is a boundary point between a region where a waveform amplitude of the voice segment is substantially constant and a region where the waveform amplitude of the voice segment varies, and wherein when the acquired voice segment where a region including a start point is a vowel phoneme, the boundary designation section designates, as the boundary, a time point later than the stationary point; and a voice synthesis section that synthesizes a voice based on a region of the vowel phoneme that precedes the designated boundary of the vowel phoneme, or a region of the vowel phoneme that succeeds the designated boundary of the vowel phoneme, wherein the start point and the end point of the vowel phoneme and the designated boundary of the vowel phoneme are time points on a time axis of the acquired voice segment, wherein when the acquired voice segment where the region including the end point is a vowel phoneme, the voice synthesis section synthesizes the voice based on the region of the voice segment preceding the boundary designated by the boundary designation section, and wherein when the acquires voice segment where the region including the start point is a vowel phoneme, the voice synthesis section synthesizes the voice based on the region of the voice segment succeeding the boundary designated by the boundary designation section.

2. A voice synthesis apparatus as claimed in claim 1, wherein:

the acquired voice segment includes a first voice segment where the region including the end point is a vowel phoneme, and a second voice segment following the first voice segment where the region of the start point is a vowel phoneme, for each of the first and second voice segments, the boundary designation section designates the boundary in the vowel phoneme, and the voice synthesis section synthesizes voices for the region of the first voice segment preceding the boundary designated by the boundary designation section, and for the region of the second voice segment succeeding the designated boundary.

3. A voice synthesis apparatus as claimed in claim 1, wherein:

a the voice segment is divided into a plurality of frames, and the voice synthesis section interpolates between the frame of a first voice segment immediately preceding the boundary designated by the boundary designation section and the frame of a second voice segment immediately succeeding the boundary designated by the boundary designation section, to thereby generate a voice for a gap between the frames.

4. A voice synthesis apparatus as claimed in claim 1, further comprising a time data acquisition section that acquires time data designating a duration time length of the voice, and wherein the boundary designation section designates the boundary in the vowel phoneme, included in the voice segment, at a time point corresponding to the duration time length designated by the time data.

5. A voice synthesis apparatus as claimed in claim 4, wherein:

when the acquired voice segment where the region including the end point is a vowel phoneme, boundary designation section designates the boundary at a time point, in the vowel phoneme included in the voice segment, closer to the end point as a longer time length is designated by the time data, and the voice synthesis section synthesizes the voice based on a region of the vowel phoneme that precedes the designated boundary in said vowel phoneme.

6. A voice synthesis apparatus as claimed in claim 4, wherein:

when the acquired voice segment where the region including the start point is a vowel phoneme, the boundary designation section designates the boundary at a time point, in the vowel phoneme included in the voice segment, closer to the start point as a longer time length is designated by the time data, and the voice synthesis section synthesizes the voice based on a region of the vowel phoneme that succeeds the designated boundary in the vowel phoneme.

7. A voice synthesis apparatus as claimed in claim 1, further comprising an input section that receives a parameter input thereto, and wherein the boundary designation section designates the boundary at a time point, of the vowel phoneme included in the voice segment acquired by the phoneme acquisition section, corresponding to the parameter input to the input section.

8. A computer-readable storage section storing a computer program executable by a computer for synthesizing a voice, the computer program including computer executable instructions for:

acquiring a voice segment including one or more phonemes;

designating a boundary intermediate between start and end positions of a vowel phoneme included in the voice segment acquired in the voice segment acquiring instruction, wherein when the acquired voice segment where a region including an end point is a vowel phoneme, the boundary designating instruction designates, as the boundary, a time point earlier than a stationary point, which is a boundary point between a region where a waveform amplitude of the voice segment is substantially constant and a region where the waveform amplitude of the voice segment varies, and wherein when the acquired voice segment where a region including a start point is a vowel phoneme, the boundary designating instruction designates, as the boundary, a time point later than the stationary point; and synthesizing a voice based on a region of the vowel phoneme that precedes the designated boundary of the vowel phoneme, or a region of the vowel phoneme that succeeds the designated boundary of the vowel phoneme, wherein the start point and the end point of the vowel phoneme and the designated boundary of the vowel phoneme are time points on a time axis of the acquired voice segment, wherein when the acquired voice segment where the region including the end point is a vowel phoneme, the voice synthesizing instruction instructs to synthesize the voice based on the region of the voice segment preceding the boundary designated by the boundary designating instruction, and wherein when the acquires voice segment where the region including the start point is a vowel phoneme, the voice synthesizing instruction instructs to synthesize the voice based on the region of the voice segment succeeding the boundary designated by the boundary designating instruction.

9. A voice synthesis method for synthesizing a voice using a voice synthesizing apparatus comprising a voice segment acquisition section, a boundary designation section, and a voice synthesis section, the method comprising the steps of:

acquiring a voice segment including one or more phonemes with the voice segment acquisition section;

designating a boundary intermediate between start and end positions of a vowel phoneme included in the voice segment acquired in the voice segment acquiring step with the boundary designation section, wherein when the acquired voice segment where a region including an end point is a vowel phoneme, the boundary designating step designates, as the boundary, a time point earlier than a stationary point, which is a boundary point between a region where a waveform amplitude of the voice segment is substantially constant and a region where the waveform amplitude of the voice segment varies, and wherein when the acquired voice segment where a region including a start point is a vowel phoneme, the boundary designating step designates, as the boundary, a time point later than the stationary point; and synthesizing a voice based on a region of the vowel phoneme that precedes the designated boundary of the vowel phoneme, or a region of the vowel phoneme that succeeds the designated boundary of the vowel phoneme with the voice synthesis section, wherein the start point and the end point of the vowel phoneme and the designated boundary of the vowel phoneme are time points on a time axis of the acquired voice segment, wherein when the acquired voice segment where the region including the end point is a vowel phoneme, the voice synthesizing step synthesizes the voice based on the region of the voice segment preceding the boundary designated in the boundary designating step, and wherein when the acquired voice segment where the region including the start point is a vowel phoneme, the voice synthesizing step synthesizes the voice based on the region of the voice segment succeeding the boundary designated in the boundary designating step.

* * * * *